US010406846B2

(12) United States Patent
Donati

(10) Patent No.: US 10,406,846 B2
(45) Date of Patent: Sep. 10, 2019

(54) METHOD FOR PRODUCING A PEN HOLDER NOTEBOOK AND NOTEBOOK PRODUCED WITH THE METHOD

(71) Applicant: FIORDO S.R.L, Romentino (NO) (IT)

(72) Inventor: Fiorenzo Donati, Romentino (IT)

(73) Assignee: FIORDO S.R.L., Romentino (NO) (IT)

( * ) Notice: Subject to any disclaimer, the term of this patent is extended or adjusted under 35 U.S.C. 154(b) by 0 days.

(21) Appl. No.: 15/814,591

(22) Filed: Nov. 16, 2017

(65) Prior Publication Data

US 2018/0141368 A1 May 24, 2018

(30) Foreign Application Priority Data

Nov. 18, 2016 (EP) ..... 16425107

(51) Int. Cl.

| | |
|---|---|
| ***B42D 1/00*** | (2006.01) |
| ***B42B 5/12*** | (2006.01) |
| ***B42D 3/12*** | (2006.01) |
| ***B42D 5/00*** | (2006.01) |

(52) U.S. Cl.

CPC ..... *B42D 1/007* (2013.01); *B42B 5/123* (2013.01); *B42D 3/12* (2013.01); *B42D 5/008* (2013.01); *B42D 5/006* (2013.01); *B42P 2241/18* (2013.01)

(58) Field of Classification Search

CPC ..... B42D 1/007; B42D 3/12; B42D 5/008; B42D 5/006; B42B 5/123; B42P 2241/18

USPC .... 281/3.1, 4, 15.1, 19.1, 20, 29, 30, 44, 45

See application file for complete search history.

(56) References Cited

U.S. PATENT DOCUMENTS

| | | | | |
|---|---|---|---|---|
| 2,383,858 A | | 8/1945 | Harris | |
| 2,486,840 A | | 11/1949 | Harris | |
| 4,610,392 A | * | 9/1986 | DaRosa | B42F 7/04 281/44 |
| 7,360,960 B2 | * | 4/2008 | Hite | B42D 5/003 281/30 |

FOREIGN PATENT DOCUMENTS

EP 2 774 774 A2 9/2014

OTHER PUBLICATIONS

European Search Report issued in Application No. 16425107, dated May 11, 2017.

* cited by examiner

*Primary Examiner* — Justin V Lewis
(74) *Attorney, Agent, or Firm* — Young & Thompson

(57) ABSTRACT

To get from a sheet of cardboard an element including an assembly of parts suitable for forming a block with conventional detachable sheets and including a conventional pen, the die-cutting and simultaneous creasing of the sheet lead to form: a) a first rectangular or square element intended for the application of a block of paper; b) a second rectangular element on a first side of the first element and of a width equal to the thickness of the block; c) a third rectangular or square element on the adjacent side of the second element and is intended to cover notebook; d) a fourth rectangular element on a second side of the first element, contiguous and of width equal to the thickness of the block; e) a fifth rectangular element, contiguous to the fourth element and of a height suitable for covering the head of the block of paper.

5 Claims, 6 Drawing Sheets

METHOD FOR PRODUCING A PEN HOLDER NOTEBOOK AND NOTEBOOK PRODUCED WITH THE METHOD

FIELD OF THE INVENTION

The paper industry is a field in which a flat sheet of cardboard or paperboard is treated by die-cutting, creasing and folding in order to obtain a common use object, a box, a food container, a toy of simple or complex shape.

STATE OF THE ART

The applicant does not know a pen holder notebook substantially achieved by a papermaking process and presenting the invented features.

There are known notebooks simply formed of by a detachable sheets block applied on a carrier of cardboard laterally bearing an area intended to accommodate a pen, the term pen standing for a pencil, a ballpoint pen, a fountain pen. There are also known note books comprising a cover element fixed, generally, on their left side.

OBJECT OF THE INVENTION

The object of the invention is to produce at a considerably low cost an object that provides immediate and convenient the possibility of writing.

BACKGROUND OF THE INVENTION

While in the following of the present description the term "cardboard" stands for cardboard or paperboard, the use of one or other in the method depends on the size and quality that the manufacturer want to give the product.

The method comprises the steps of:

A) Die-cutting and creasing of a cardboard sheet to obtain a single element comprising an assembly of parts suitable for receiving a detachable sheets block and hold a conventional pen, where the assembly of parts is:

a—a first rectangular or square element in part intended for the application of the detachable sheets block, b—a second rectangular element on a first side of the first element and of a width equal to the thickness of the detachable sheets block, c—a third rectangular or square element on the adjacent side of the second element and intended as notebook cover, d—a fourth rectangular element on a second side of the first element of width equal to the thickness of the detachable sheets block, and e—a fifth rectangular element, contiguous to the fourth element and of height suitable for covering the head of the detachable sheets block.

B) Apply the detachable sheets block on the bottom surface of the first element, C) Fold the above elements along the creasings to get a notebook that includes a pen within a chamber at the upper end or at a side of the block.

The produced notebook is compact, complete with the detachable sheets block, the cover and the pen.

ADVANTAGES OF THE INVENTION

The process is very fast and the structure of the product allows a user to carry a notebook with the pen readily available.

EXAMPLE OF THE INVENTION

The invention will now be described in detail with examples of embodiment and the help of the drawing in which.

Figure 1:
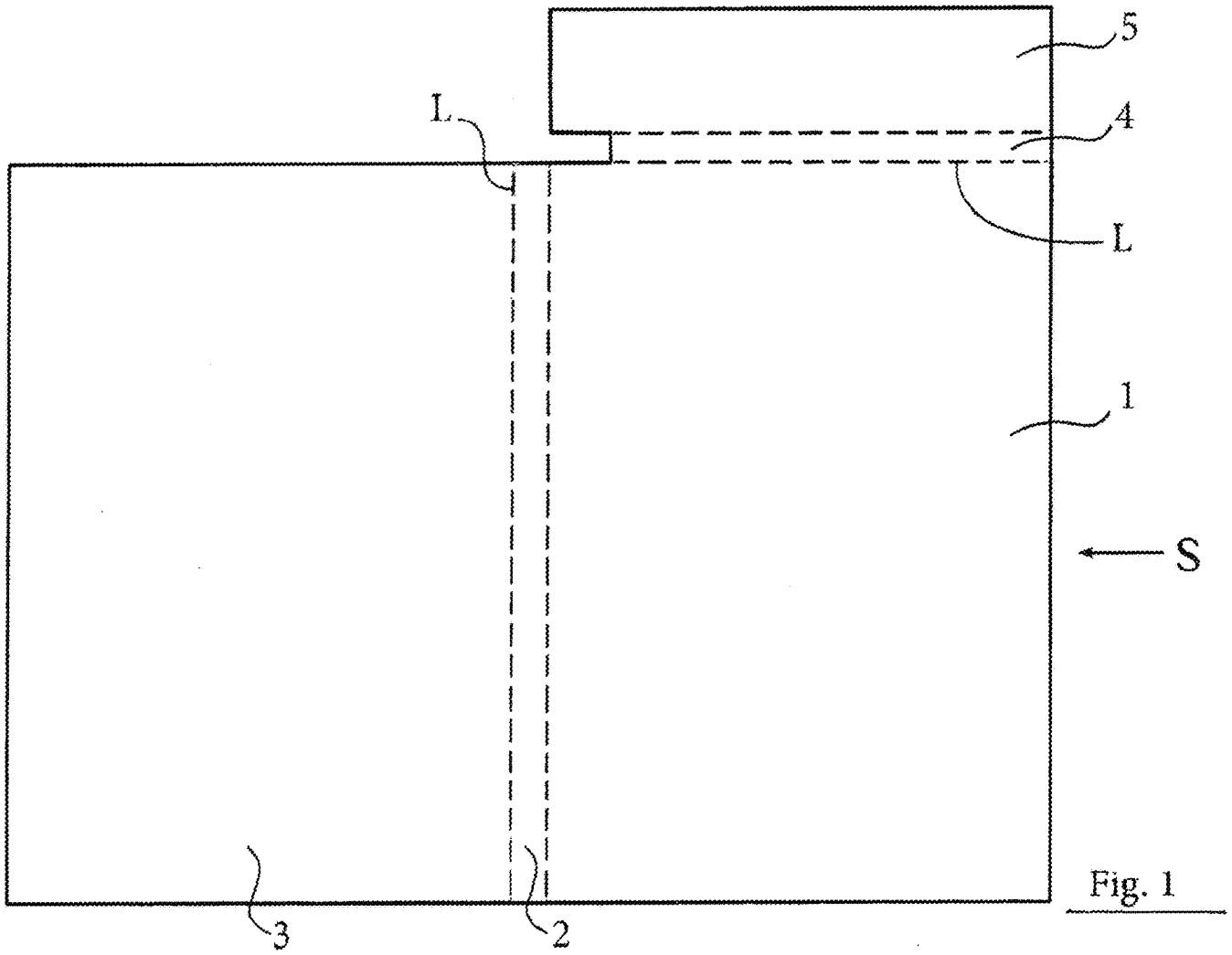
FIG. 1 is a first plan view.

A first alternative shows the position of a ballpoint pen on the upper end of the block:

FIG. 1 shows the assembly of parts formed by die-cutting and creasing of a cardboard sheet S which defines a first rectangular element 1 having a height of 16.3 cm and a width of 10.5 cm intended for the application of a detachable sheets block having a height of 14.8 cm and a width of 10.5 cm; a second rectangular element 2 on a first side of the first element 1 and of a width equal to the thickness of the detachable sheets block equal to 1.0 cm; a third rectangular element 3 on the adjacent side of the second element 2 and intended to cover the notebook in production; a fourth rectangular element 4 on a second side of the first element 1, of width equal to the thickness of the detachable sheets block; a fifth rectangular element 5, contiguous to the fourth element and of height suitable for covering the head of the detachable sheets block; the L lines separating these parts and carrying the crease lines which allow to bend the die-cut elements and where the fourth rectangular element 4 has a length lower than the width of the fifth element to leave visible and accessible the pen.

Figure 2:
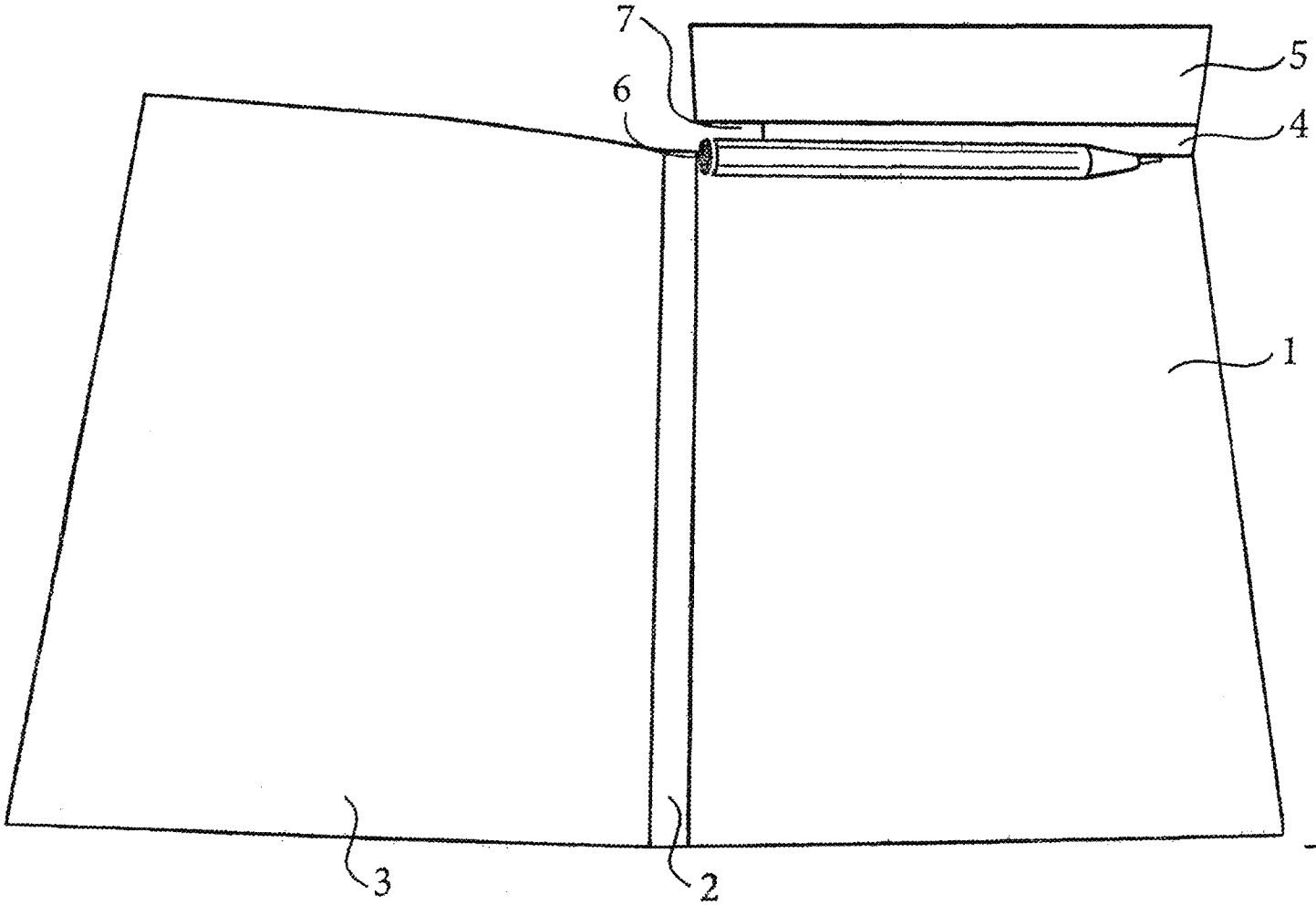
FIGS. 2-8 are perspective views.

FIG. 2 shows a ballpoint pen 6 placed on top of the first element 1. It is understood that, once the element 4 is folded in perpendicular position with respect to the first element 1 and the element 5 is folded parallel to the element 1, a chamber is obtained adapted to receive the pen, the chamber having a window 7 created by the reduced length of the element 4 to make visible and accessible one end of the pen.

Figure 3:
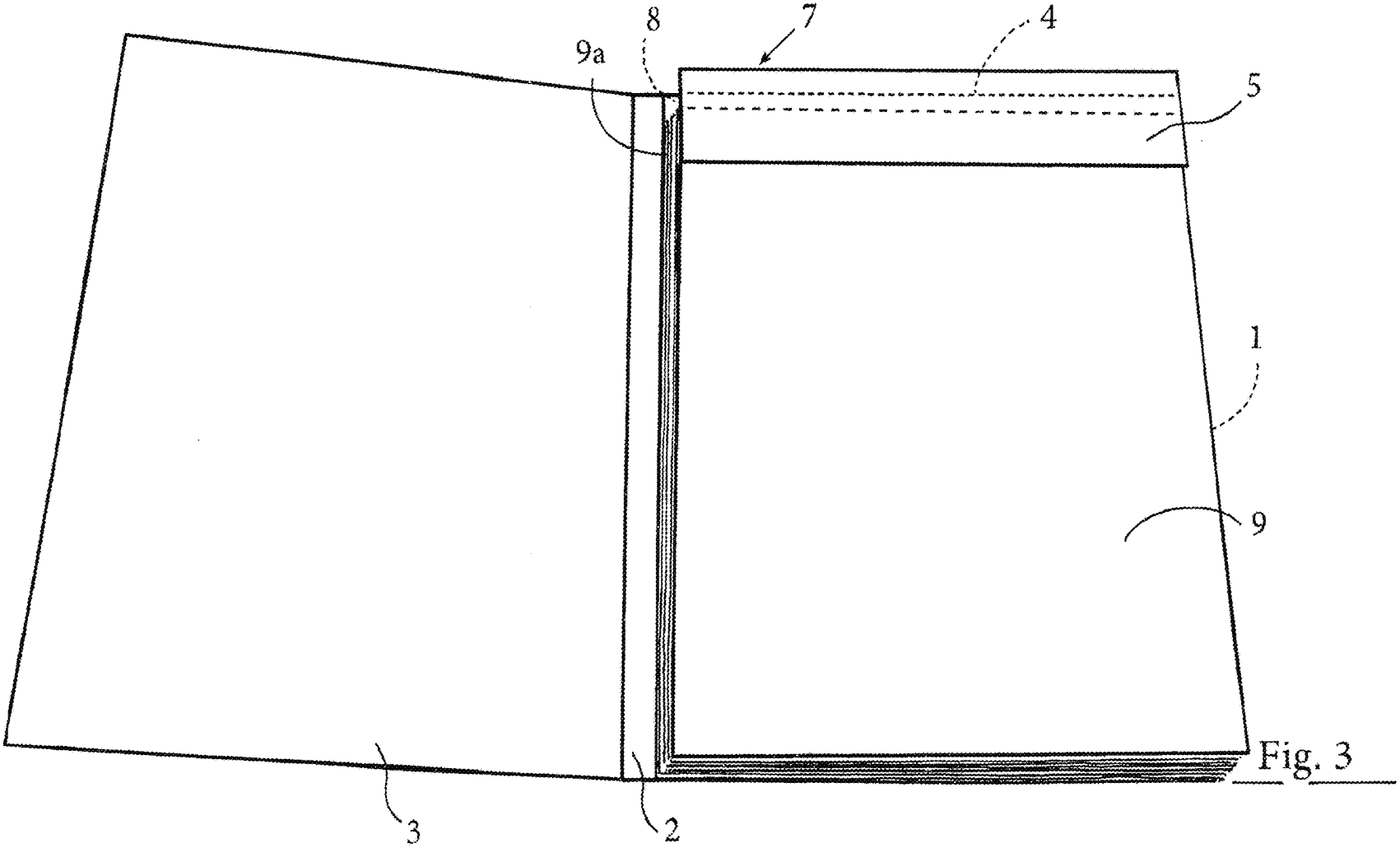

FIG. 3 shows a detachable sheets block 9, of 1.0 cm thickness, crimped to lower part of the first rectangular element 1, the fourth rectangular element 4 of 1.0 cm height covers the head 9*a* and the detachable sheets block 9, the window 7 created in the rectangular element 4 and the rectangular chamber 8 adapted to receive a pen, not shown.

Figure 4:
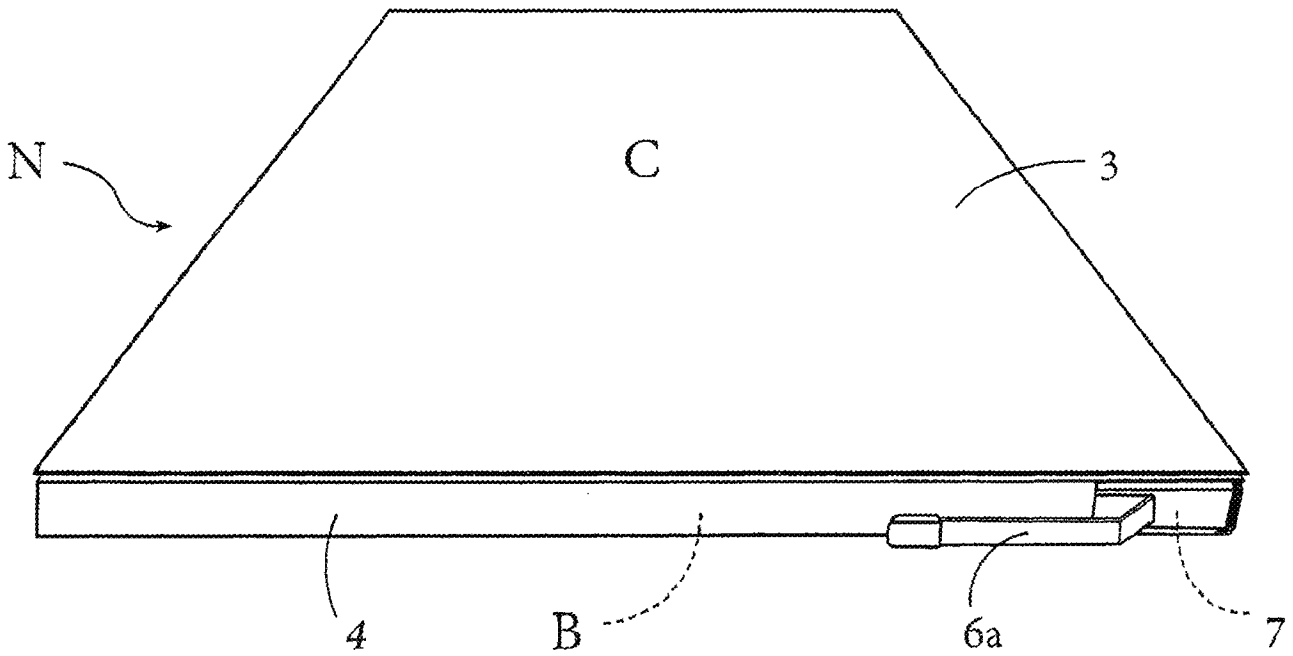

FIG. 4 shows a notebook finished where 4 indicates the rectangular element with its window 7 in which the clip 6*a* appears of a pen hidden in the chamber 8 created within the elements 1, 4, and 5.

Figures 5, 6:
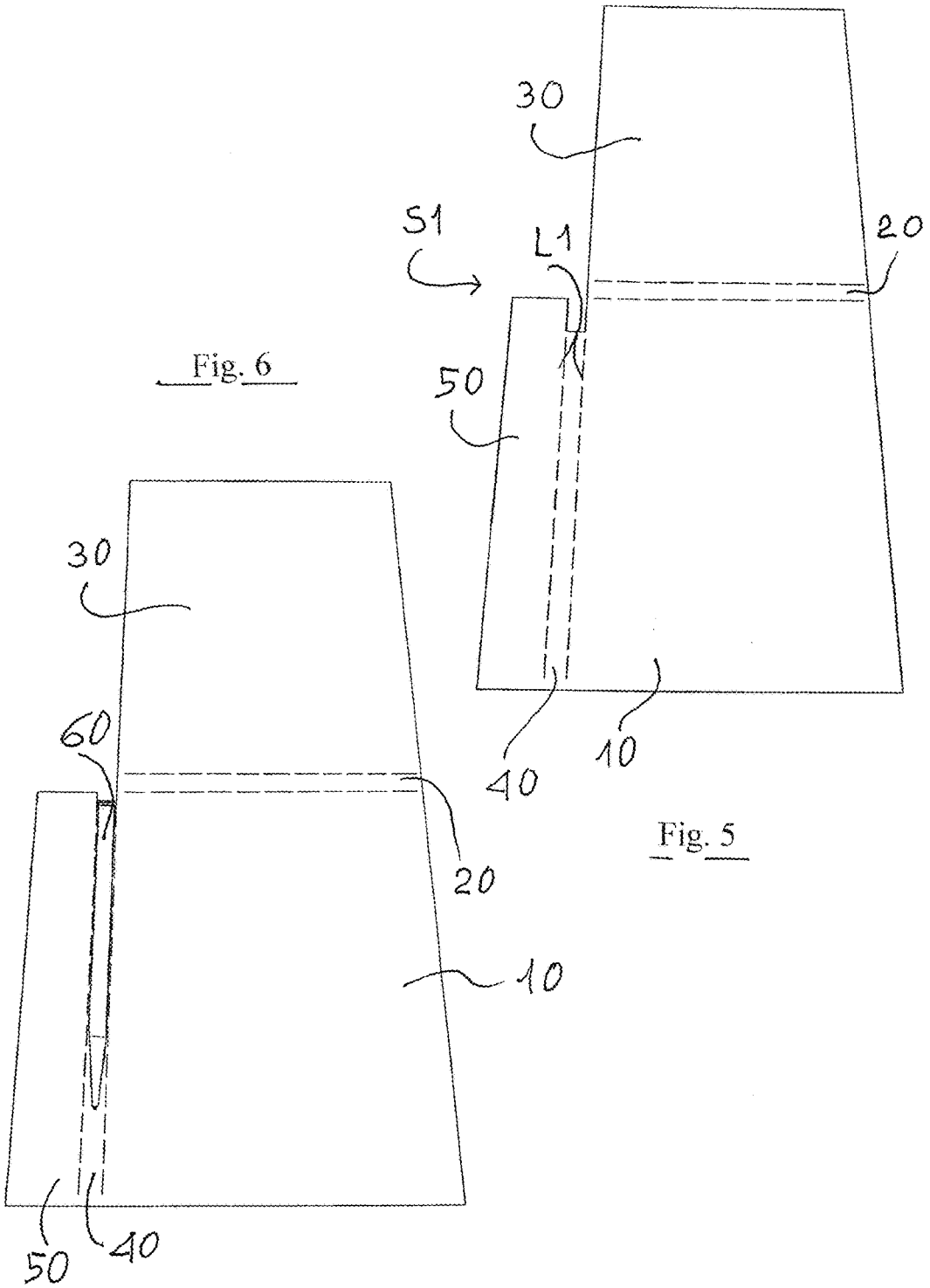

A second alternative shows the position of a ballpoint pen 60 on one side of the block:

FIG. 5 shows a cardboard sheet S1 which defines a first rectangular element 10 intended for the application of a detachable sheets block; a second rectangular element 20 on a first side of the first element 10 and of a width equal to the thickness of the detachable sheets block equal to 1.0 cm; a third rectangular element 30 on the adjacent side of the second element 20 and intended to cover the notebook in production; a fourth rectangular element 40 on a second side of the first element 10, of width equal to the thickness of the detachable sheets block; a fifth rectangular element 50, contiguous to the fourth element and of height suitable for covering the side of the detachable sheets block; the two parallel L1 lines separating these parts and carrying the crease lines which allow to bend the die-cut elements and where the fourth rectangular element 40 has a length lower than the width of the fifth element to leave visible and accessible the pen.

FIG. 6 shows a ballpoint pen 60 lying on the element 40 defined between the elements 10 and 50.

Figure 7:
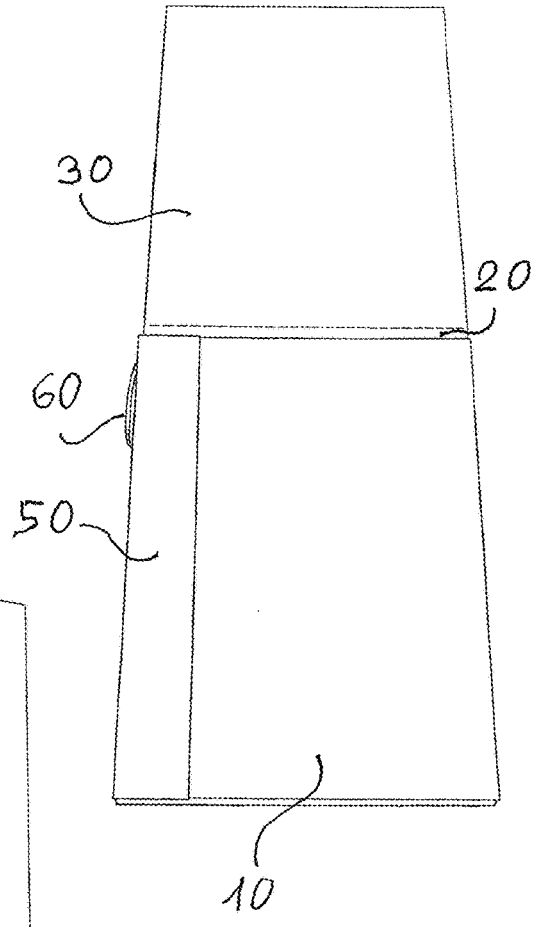

FIG. 7 shows the element 50 overturned on the element 10 to define the chamber where the ballpoint pen is held.

Figure 8:
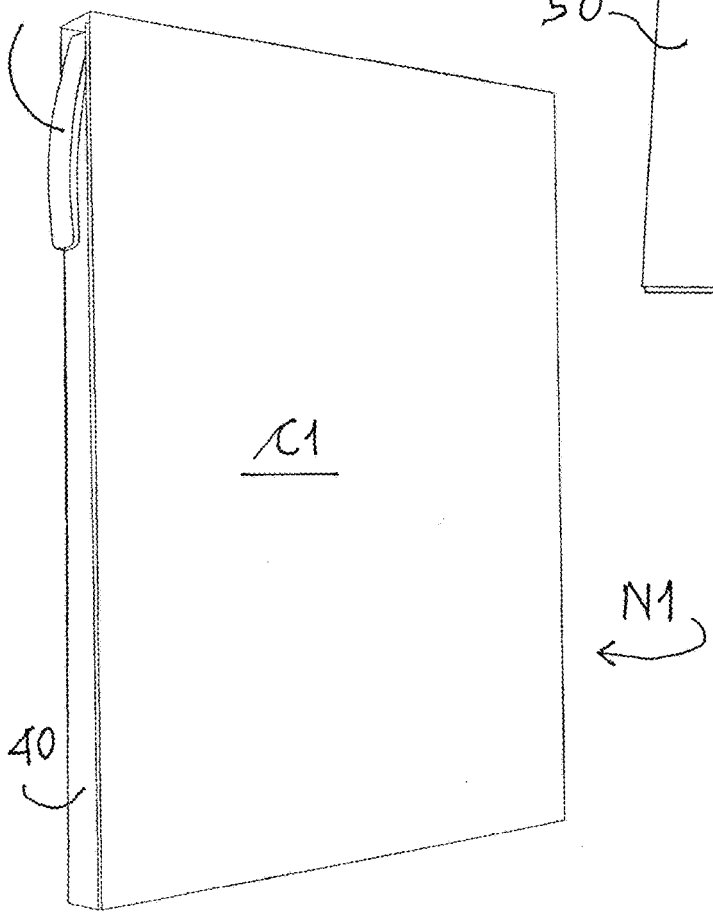

FIG. 8 shows the element 30 overturned to cover the block. Also the outer side of the element 40 and the pen clip 6*b* are visible.

The invention claimed is:

1. A method for producing a pen holder notebook in which parts configured to contain a detachable sheets block and a pen are obtained by die-cutting and creasing of a cardboard sheet, the method comprising:

die-cutting and creasing of the cardboard sheet to obtain a single element in which an assembly of parts configured to form a notebook holding the detachable sheets block and the pen, the assembly of parts including:

a first rectangular or square element configured for an application of the detachable sheets block, a second rectangular element on a first side of the first element and having a width equal to a thickness of the detachable sheets block, a third rectangular or square element on an adjacent side of the second element and configured as a cover of the notebook, a fourth rectangular element on a second side of the first element of width equal to the thickness of the detachable sheets block, and a fifth rectangular element contiguous to the fourth element and having a height configured to cover a head or a side of the detachable sheets block, the height of the fifth rectangular element being more than double the width of the fourth rectangular element;

fixing the detachable sheets block on a lower part of the first element; and folding the first through fifth elements to form the pen holder notebook with a chamber configured to receive the pen, the fifth rectangular element being folded over the first element and configured to overlap the head or the side of the detachable sheets block to define the chamber adjacent to the head or the side of the detachable sheets block such that the pen is received within the chamber adjacent to the head or the side of the detachable sheets block.

2. The method according to claim 1, wherein the fourth rectangular element has a length less than a width of the first element to create a window which makes visible part of the chamber.

3. A notebook produced by the method according to claim 1, the notebook comprising:

the detachable sheets block fixed on a part of a base element in which a portion remains uncovered to define the chamber for the pen, the chamber being generated by the fifth rectangular element that covers the pen and part of the detachable sheets block, and the third element acting as the cover.

4. The notebook according to claim 3, wherein a window is disposed on one side of the chamber to make visible one end of the pen.

5. A notebook produced by the method according to claim 2, the notebook comprising:

the detachable sheets block fixed on a part of a base element in which a portion remains uncovered to define the chamber for the pen, the chamber being generated by the fifth rectangular element that covers the pen and part of the detachable sheets block, and the third element acting as the cover.

* * * * *